United States Patent [19]

Bake, Jr.

[11] Patent Number: 4,533,050

[45] Date of Patent: Aug. 6, 1985

[54] CUSHIONED CONTAINER

[76] Inventor: Louis S. Bake, Jr., 4625 24th Rd. North, Arlington, Va. 22207

[21] Appl. No.: 579,166

[22] Filed: Feb. 10, 1984

[51] Int. Cl.[3] ..... A45C 11/20

[52] U.S. Cl. ..... 206/545; 206/217; 220/444; 220/902; 62/371; 5/442

[58] Field of Search ..... 206/545, 217; 220/444, 220/467, 902; 62/371; 5/442; 383/40

[56] References Cited

U.S. PATENT DOCUMENTS

| | | | |
|---|---|---|---|
| 2,496,296 | 2/1950 | Lobl | 206/545 |
| 2,555,788 | 6/1951 | Donaldson | 206/545 |
| 3,139,632 | 7/1964 | Johns | 5/442 |
| 3,353,886 | 11/1967 | Tompkins | 206/545 |
| 3,436,932 | 4/1969 | Paquin . | |
| 3,443,397 | 5/1969 | Donovan et al. . | |
| 3,591,768 | 7/1971 | Terres | 206/545 |
| 3,938,569 | 2/1976 | Hill | 5/442 |
| 3,974,658 | 8/1976 | Starrett | 62/60 |
| 4,050,264 | 9/1977 | Tanaka | 62/457 |
| 4,116,310 | 9/1978 | Shields | 383/40 |
| 4,143,795 | 3/1979 | Casebier | 220/23.4 |
| 4,247,961 | 2/1981 | Masch et al. | 5/442 |
| 4,280,336 | 7/1981 | Taylor | 62/457 |
| 4,295,345 | 10/1981 | Atkinson | 62/371 |
| 4,311,022 | 1/1982 | Hall | 62/457 |
| 4,376,494 | 3/1983 | Bjurling | 220/444 |
| 4,399,668 | 8/1983 | Williamson | 62/457 |
| 4,449,378 | 5/1984 | Thorpe | 62/371 |

FOREIGN PATENT DOCUMENTS

| | | | |
|---|---|---|---|
| 631937 | 9/1982 | Switzerland | 206/217 |

*Primary Examiner*—George E. Lowrance
*Assistant Examiner*—Brenda J. Ehrhardt
*Attorney, Agent, or Firm*—Thomas A. Beck

[57] ABSTRACT

A cushioned container capable of simultaneous use as a seat cushion and as a cooling container. The container holds in separate compartments separate containers having first chambers for receiving a cooling medium and second chambers for receiving consumable materials, for example, canned or uncanned beverages.

14 Claims, 4 Drawing Figures

10
11
12
13
14
15
16
17
18
19
20
22
24
25
26
3
4

CUSHIONED CONTAINER

This invention relates to containers, and, more particularly, to containers which are suitable for containing consumable materials and maintaining them in a cooled condition. An embodiment of the container of the present invention is suitable for simultaneous use as a seat cushion and a receptacle for containing consumable materials.

One prior cooling container is disclosed in U.S. Pat. No. 3,401,535 in which the container contains a cooling medium in the space between the outer container and an insert having formed cavities therein for receiving canned beverages.

U.S. Pat. No. 3,726,106 discloses a self-heating or cooling container having in one embodiment two separable sections of the container, one for enclosing a cooling or heating chemical and the other for enclosing the product to be cooled or heated, and in another embodiment a cooling or heating section within the product section.

In general, prior containers for cooling canned beverages or the like cool items packed within the container in a generally uniform manner without the capability of selectively cooling the items. Further, prior cooling devices have, in general, not functioned simultaneously as seat cushions, particularly adaptable for use in confined spaces such as boats, small automobilies or seating facilities of a football stadium.

It is an object of the present invention, therefore, to provide a new and improved cushioned container which avoids one or more of the limitations and disadvantages of prior containers.

It is another object of the invention to provide a new and improved cushioned container which is suitable for simultaneous use as a seat cushion and as a receptable for containing consumable materials.

It is another object of the invention to provide a new and improved cushioned container which can be precooled by placing part or all of the container in the freezer compartment of a home refrigerator.

It is another object of the invention to provide a new and improved cushioned container from which beverages can be drawn by an individual sitting on the container.

It is another object of the invention to provide a new and improved cushioned container which is buoyant.

In accordance with the invention, a cushioned container comprises an inner enclosure having an outer cushion layer bounding at least a portion of the inner enclosure. A first container is disposed in the enclosure and a plurality of second containers are adapted for disposition in the first container and individually have first chambers for receiving temperature-controlling material therein and individually have second chambers for receiving consumable material.

For a better understanding of the present invention, together with other and further objects thereof, reference is made to the following description, taken in connection with the accompanying drawings, and its scope will be pointed out in the appended claims.

Referring now to the drawings.

Figures 1, 2:
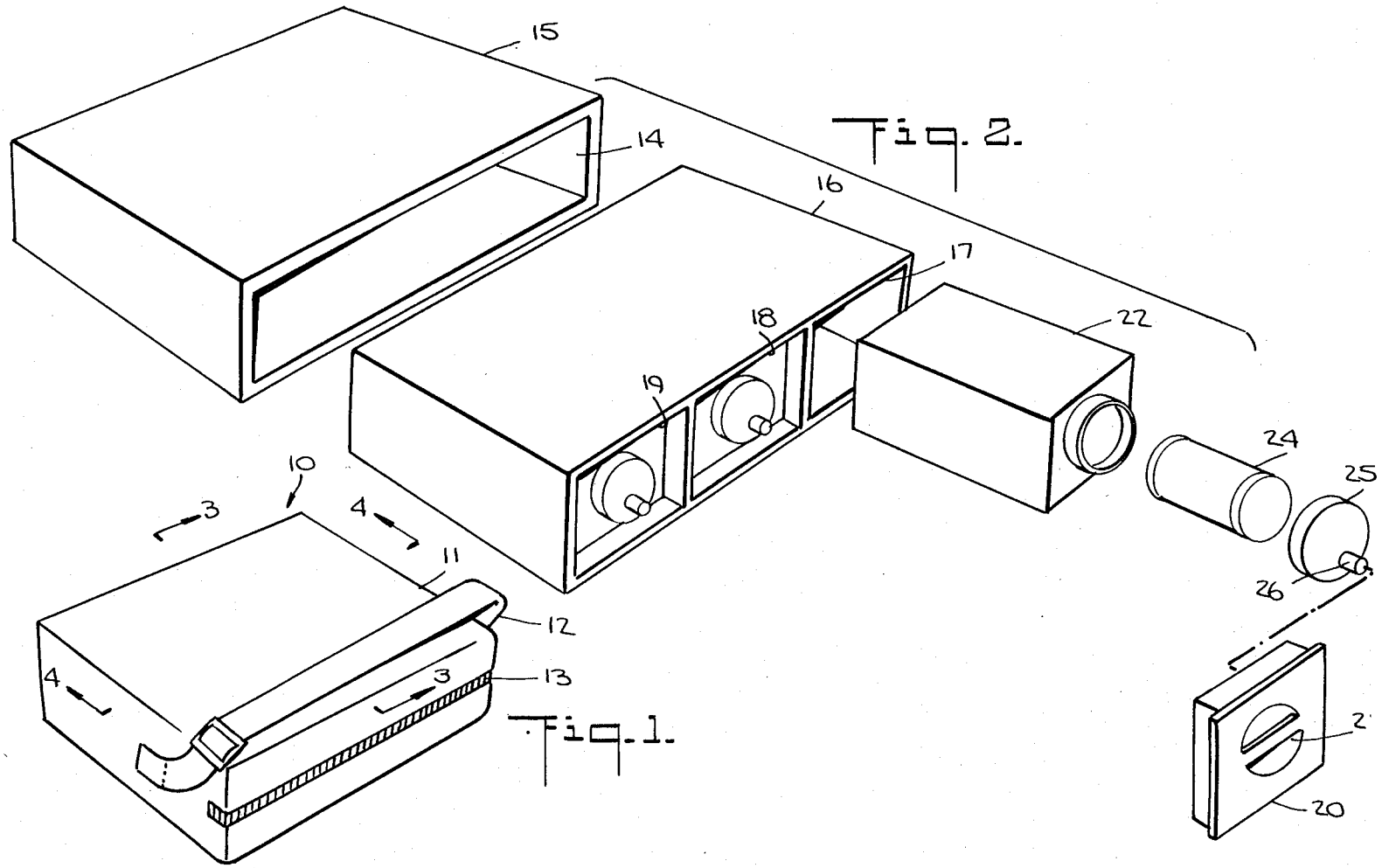
FIG. 1 is a perspective view of a cushioned container constructed in accordance with the invention.
FIG. 2 is an exploded view, in perspective, of the FIG. 1 container with the outer cover removed and with a canned beverage shown for disposition in the container.

Referring now more particularly to FIG. 1 of the drawings, a cushioned container 10 is there represented with an outer cover 11 having a strap handle 12 and having an opening at one end closed by, for example, a zipper 13.

The outer cover 11 preferably is made of a strong durable fabric such as Naugahyde, a registered trademark, canvas or similar material in order to provide durability, color retention, weatherproofing and the like. Any suitable fastener which ensures a tight closing may be utilized instead of the zipper 13.

Referring now more particularly to FIG. 2 of the drawings, individual parts of the cushioned container are represented in exploded view with the outer cover 11 removed. The container comprises an inner enclosure 14 having an outer cushion layer 15 bounding at least a portion of the inner enclosure. The cushion layer 15 has a generally rectangular cross-section and comprises, for example, a continuous piece or separate or shredded pieces of foam rubber, polystyrene foam, down or similar material formed into the cushion layer 15. The cushion layer 15 may be covered with a thin type of fabric of such thickness and quality as to be capable of providing form retention, compactness, waterproofing or similar features depending on the type of material used to form the cushion. The cushion layer 15 also serves as insulation against temperature variation of the contents of the container 16.

The container 10 also includes a first container 16 disposed in the enclosure 14. The container 16 preferably has a generally rectangular cross-section and has compartments therein 17, 18, 19 of generally rectangular cross-section. The container 16 preferably is molded as a single piece from a plastic material such as polycarbonate, polystyrene, polypropylene or similar material which would have properties of strength, flexibility and durability. The container 16 may also be constructed of individual pieces of the same or similar material joined together by cement, heat or any process that would ensure a permanent bond. The container 16 is represented as having straight edges, but the edges may be slightly rounded in order to ensure ease of insertion or prevent damage to the enclosure 14 of the foamed cushion 15. The edges may also be slightly rounded to ensure ease of molding or construction or to lower cost. The container 16 also serves as insulation against temperature variation of the contents of the container 16.

Compartments 17, 18, 19 are separate compartments, each being separated from the adjacent compartment by a divider wall made generally of the same material as the container 16. Each compartment 17, 18, 19 has an opening at one end and the divider wall separating each pair of compartments extends from one end of the opening to the opposite end and is permanently attached to all sides of the recepacle. The container also includes a plurality of closures for the compartments. These closures are, for example, snap-on lids, such as the lid 20, which are generally made of the same type of material as the container 16 and have a handgrip 21 to facilitate opening and closing. Each compartment 17, 18 or 19 is capable of receiving a second container such as container 22 to be described subsequently or, with the use of the snap-on lid, separate items such as ice, food, utensils or the like.

Figure 3:
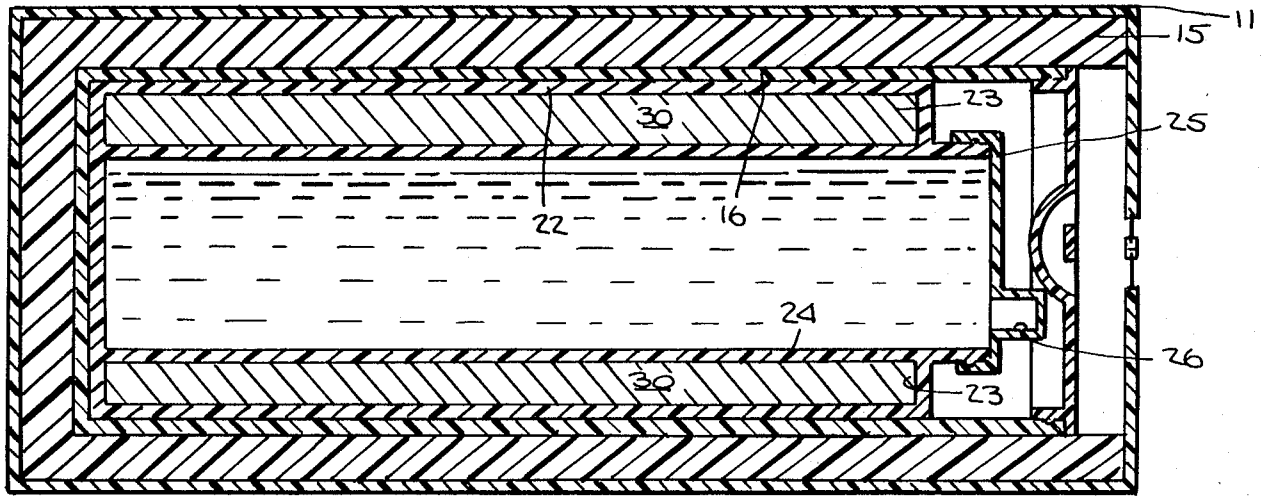
FIG. 3 is a sectional view of the FIG. 1 container, taken along line 3—3 of FIG. 1 with the outer cover removed.
Figure 4:
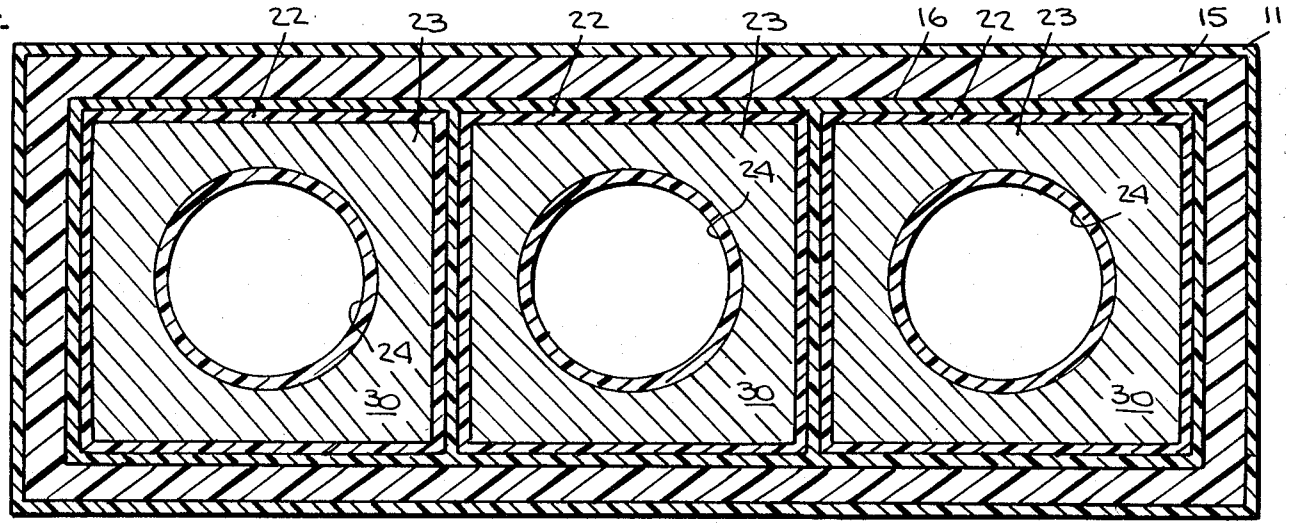
FIG. 4 is a sectional view of the FIG. 1 container taken along line 4—4 of FIG. 1 and with the outer cover removed.

The cushioned container also includes a plurality of second containers 22 adapted for disposition in the first container 16 and individually having first chambers 23 for receiving temperature-controlling materials therein and individually having second chambers 24 for receiving consumable materials are represented in FIGS. 3 and 4. The second chambers 24 preferably are individually surrounded by the first chambers 23. Each container 22 preferably has a generally rectangular cross-section with a cylindrically formed inner chamber 24 and surrounded by a cooling medium 30 in the first chamber 23. The cooling medium preferably is disposed in the chamber 23 during manufacture of the container 12, or, alternatively, the chambers 23 may have an intake valve or inlet (not shown) through which the cooling medium may be introduced into the chamber 23 by the user. The cooling medium 25 preferably is a substance which can be frozen in the range of between 32° and 0° F., for example, water, a combination of water and methyl alcohol, or a combination of water and etylene glycol or a commercially sold gel-like substance which retains coldness by being exposed to subfreezing temperatures for a period of time. The second chambers 24 of the second containers 22 individually are containers of substantially circular inner cross-section for receiving canned beverages. The cushioned container includes a plurality of closures for the second chambers 24. The closures 25 for the second chambers 24 individually include spigots 26 which can be opened and closed by an individual seated on the cushioned container to release the liquid contents of the chambers 24 in the event the chambers 24 have been filled with a liquid beverage rather than with canned beverages.

The container 15 may or may not be frozen depending on the needs of the user. If freezing is desired, one or more of the containers 22 may be placed in, for example, the freezer portion of a home refrigerator to freeze the cooling medium. The containers 22 may then be inserted into the compartments 17, 18, 19 or alternatively, the container 16 with the containers 22 therein may be placed in the freezer. Canned beverages such as the can 27 or other items or liquid beverages can then be placed on the chambers 24 as represented in FIGS. 3 and 4. If liquids such as beer, wine, cola, juices or the like are used rather than canned beverages or other items in one or more of the chambers 24, as represented in FIGS. 3 and 4, then a screw-on closure 24 may be used to close such chamber 24. The chamber 24 may be tightened securely by twisting on the closure. The spigot 26 may then be used to dispense the liquid after either removing the container 22 from the compartments 17, 18, 19 or leaving the container 22 in place. If the container 22 is left in place in the container 16, the liquid can be easily dispensed with an individual sitting on the cushioned cooler.

The snap-on lid or lids 20 may or may not be inserted in the compartments prior to closing the outer protective covering 11 with the zipper 13. If used, the snap-on lid may be held in each compartment by means of a tongue and groove which ensure that the lid will not inadvertently become disengaged with the compartment due to pressure caused by excessive weight exerted upon the exterior of the cushioned cooler.

From the foregoing description, it will be seen that the cushion 15, and thus the entire container 10, is buoyant and can assist as a buoyant or floatable seat cushion in a boat. Also, the cushioned container 10 may be used to keep consumable contents warm or hot if a heat-retaining medium is used in lieu of the cooling medium 30.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A cushioned container capable of simultaneous use as a seat cushion and a receptacle for containing consumable materials comprising, an inner enclosure having an outer cushion layer bounding at least a portion of said inner enclosure, first container disposed in said inner enclosure having a plurality of compartments of first respective predetermined cross-sectional shapes, a corresponding plurality of second containers individually having first chambers for receiving temperature controlling materials, and individually having second chambers for receiving consumable materials, said second containers being adapted for disposition in the respective compartments of said first container, said second containers having second respective predetermined cross-sections of complementary shape and size with respect to said first respective cross-sectional shapes such that the combination of respective said second containers disposed in said first container furnish predetermined support for said outer cushion layer to permit use of said cushioned container as a seat cushion.

2. A cushioned container in accordance with claim 1 in which said first container has a rectangular cross section and said compartments individually have rectangular cross sections.

3. A cushioned container in accordance with claim 2 in which said plurality of second containers individually have rectangular outer cross sections.

4. A cushioned container in accordance with claim 1 in which said outer cushion layer is an insulating layer.

5. A cushioned container in accordance with claim 1 in which said second chambers are individually surrounded by said first chambers.

6. A cushioned container in accordance with claim 1 in which said second chambers individually are containers of substantially circular inner cross section.

7. A cushioned container in accordance with claim 1 which includes a plurality of closures for said second chambers.

8. A cushioned container in accordance with claim 7 in which said plurality of closures for said second chambers individually includes spigots which can be opened and closed.

9. A cushioned container in accordance with claim 8 in which said spigots are so positioned that said spigots can be opened and closed while someone is seated on said cushioned container.

10. A cushioned container in accordance with claim 1 in which said outer cushion layer comprises a wall having top and bottom portions and at least two side portions bounding said inner enclosure.

11. A cushioned container in accordance with claim 1 which includes a cover over said outer cushion layer.

12. A cushioned container in accordance with claim 1, having a first side portion that opens to provide access to said second containers, and in which the second chambers of said second containers have an open end portion and a closure for detachably closing said open end portion, said cushioned container being usable as seat when oriented in a position wherein said closures are accessible through the first side portion of said cushioned container.

13. A cushioned container in accordance with claim 1, with a first pair of opposite side wall portions, one of said side walls having an opening for providing access to said second containers, said second containers being elongated in a direction extending between said first pair of opposite side walls.

14. A cushioned container in accordance with claim 13, in which said second containers have an open end portion and a closure for detachably closing said open end portion, said second containers being accessible through the opening in said one side wall when said cushioned container is being sat upon.

* * * * *